United States Patent [19]

Zimmer

[11] 3,988,986

[45] Nov. 2, 1976

[54] ANTI-DROOLING DEVICE FOR SCREEN-PRINTING MACHINE

[76] Inventor: Peter Zimmer, Untere Sparchen 54, A 6330 Kufstein, Austria

[22] Filed: Jan. 6, 1975

[21] Appl. No.: 538,560

Related U.S. Application Data

[63] Continuation of Ser. No. 348,703, April 6, 1973, abandoned.

[30] Foreign Application Priority Data

Apr. 10, 1972 Austria ..... 3047/72

[52] U.S. Cl. ..... 101/119; 101/120; 101/123; 101/124; 118/213; 118/406

[51] Int. Cl.[2] ..... B41F 15/42; B05C 1/08

[58] Field of Search ..... 101/115, 116, 119, 120, 101/122, 123, 124; 118/213, 406

[56] References Cited

UNITED STATES PATENTS

| | | | |
|---|---|---|---|
| 3,232,224 | 2/1966 | Kramer | 101/120 |
| 3,592,132 | 7/1971 | Weber | 101/119 |
| 3,731,623 | 5/1973 | Bubley et al. | 101/123 X |

FOREIGN PATENTS OR APPLICATIONS

| | | | |
|---|---|---|---|
| 1,565,279 | 4/1969 | France | 101/120 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

An arrangement on screen printing machines, particularly rotary screen printing machines, in which the dyestuff is taken from a dye pan and passed through the apertures in a screen and is applied onto the web of goods to be treated, which comprises a dye shutter disposed in the penetration zone for the dyestuff on the side of the screen remote from the weg of goods, to be closed when the machine is stopped.

6 Claims, 4 Drawing Figures

ANTI-DROOLING DEVICE FOR SCREEN-PRINTING MACHINE

This is a continuation of application Ser. No. 348,703, filed 6 Apr. 1973 and now abandoned.

My present invention relates to an anti-drooling device for screen printing machines, particularly those of the rotary type, in which the dye is drawn from a dye pan or a pool and is distributed through an apertured cylindrical screen onto a substrate or web of goods to be imprinted, the screen being rotatable about a substantially horizontal axis.

In certain conventional systems of this type, the dye is applied upstream of a scraping element or squeegee in the form of a roller or a doctor blade which achieves a hydrodynamic increase in pressure in a penetration zone of the screen where the dye accumulates in a pool on that side of the printing screen which is remote from the web of goods, i.e. on the upper surface of a screen portion overlying the substrate; with other constructions, the scraper element is disposed in the interior of a dye pan in which the dye may also be subjected to static pressure. Also known are systems with so-called split applicators wherein a dyestuff of low viscosity passes purely under static pressure, thus without the use of a roller or spreading blade, out of a slit in the bottom of the dye pan and through the apertures in the screen into or onto the substrate.

All these arrangements have the disadvantage that, if there is an interruption in the printing process, the dyestuff present in the dye pan of the stationary machine continues to drool onto the now likewise stationary substrate, making it unusable not only at this location but also, in most cases, over a larger area on account of the excess of dye being dragged along when the machine is subsequently restarted.

It has therefore already been proposed to provide special means for extracting the dyestuff from the dye pan of a stopped machine of this kind. This solution is unsatisfactory because, on the one hand, the extraction process takes a certain length of time during which the flow of dyestuff is still present and, on the other hand, complete extraction is virtually not feasible.

The object of the present invention is to provide an arrangement which immediately and completely prevents the flow of dyestuff in the penetration zone when the machine is stationary.

According to the invention, I achieve this object with the aid of shutter means for obstructing the penetration zone for the dyestuff, on the side of the screen remote from the substrate, when the machine is stationary, the shutter means being interposed between the screen and an applicator closely spaced above the path of movement of the screen.

This and other features of my invention will now be explained in greater detail with reference to the accompanying diagrammatic drawing in which.

Figure 1:
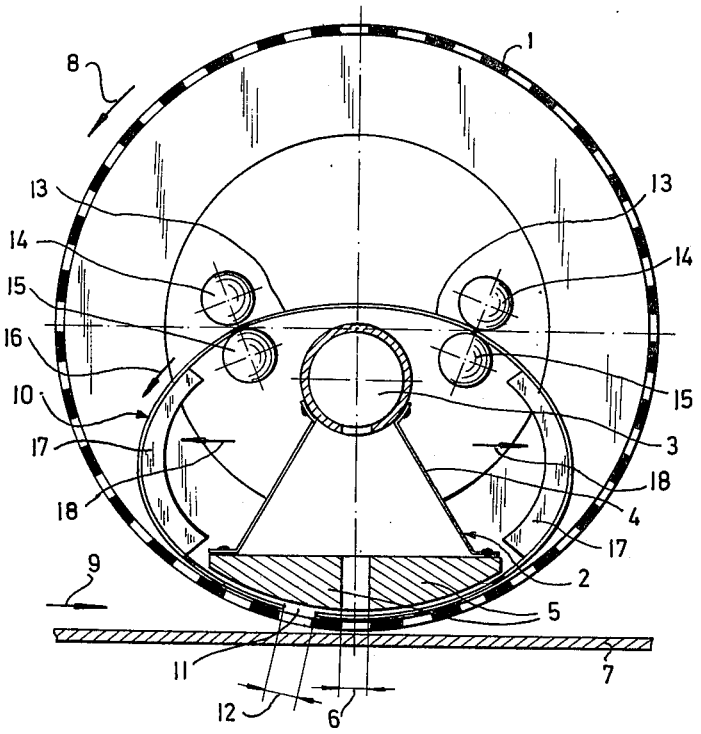
FIG. 1 shows a cross-sectional view of an arrangement according to the invention.
Figure 2:
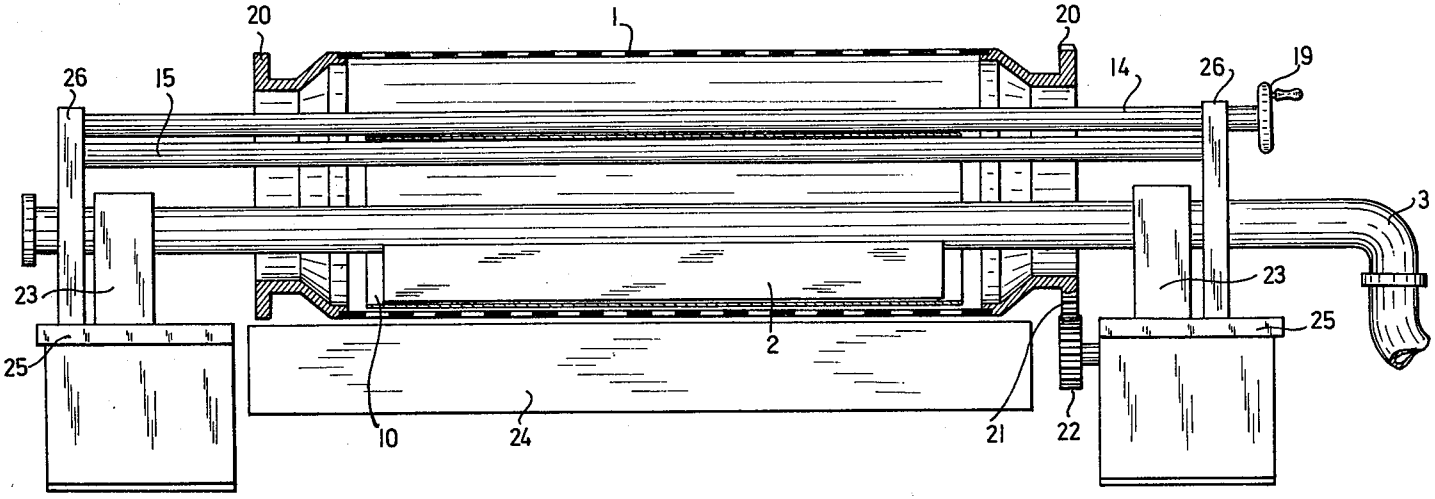
FIG. 2 shows a corresponding longitudinal section.

In FIGS. 1 and 2 I have shown inside a cylindrical screen 1 a split scraper or two-part applicator 2 which consists of a dye tube 3, a pressure chamber 4, and a pair of sealing strips 5 separated by a longitudinal gap or slit 6. When the machine is operating, it is possible in the region of the slit 6 for liquid dye to flow from the pressure chamber 4 onto a substrate or web of goods 7 located beneath the screen 1. In this case, the screen 1 rotates in the direction 8. The substrate 7 is conveyed in the direction of the arrow 9. The split scraper 2 is enclosed by an elastic metal strip 10 movable with a narrow clearance between screen 1 and applicator members 5. Strip 10 is shown as a thin-walled metal tube in the form of a substantially elliptical cylinder with a wall thickness of approximately 0.15 mm having a passage 11 of width 12 slightly larger than that of gap 6. The passage 11 need not be a throughgoing slit but, to preserve the continuity of tube 10 in a peripheral direction, may be constituted by a series of perforations. Furthermore, this metal strip 10 may be perforated in the region 13 so that, by virtue of serrations in rollers 14 located above respective counter-rollers 15, tube 10 can be rotated about its axis in the direction of arrow 16 from the blocking position shown in the drawing into an unblocking position in which the passage 11 registers with the gap 6 so that dye can pass through it and through a narrow penetration zone at the nadir of the screen 1 to the substrate 7. In order that the metal strip 10 accurately performs the intended movement, it is held in its generally elliptical shape by curved guides 17 slidably engaging it from within at the narrow vertices of its cross-section. Once the scraper or applicator has been installed in the interior of the screen, these guides are locked in position while bearing upon the inner surface of sheet 10 as indicated by arrows 18.

A handwheel 19 shown in FIG. 2, mounted on an end of one of the rollers 14, allows these rollers to be normally rotated so that the desired displacement of the metal strip 10 is effected. One of the two end supports 20 for the screen 1 has gear teeth 21 in mesh with a driving pinion 22. The dyestuff tube 3 is held in mountings 23 whose height is adjustable so that the height of the split scraper 2, supported on tube 3, can be adapted to the particular circumstances of use. Beneath the screen 1 is the printing table 24. The rollers 14 and 15 are mounted on the machine frame 25 in bearings 26.

Figure 3:
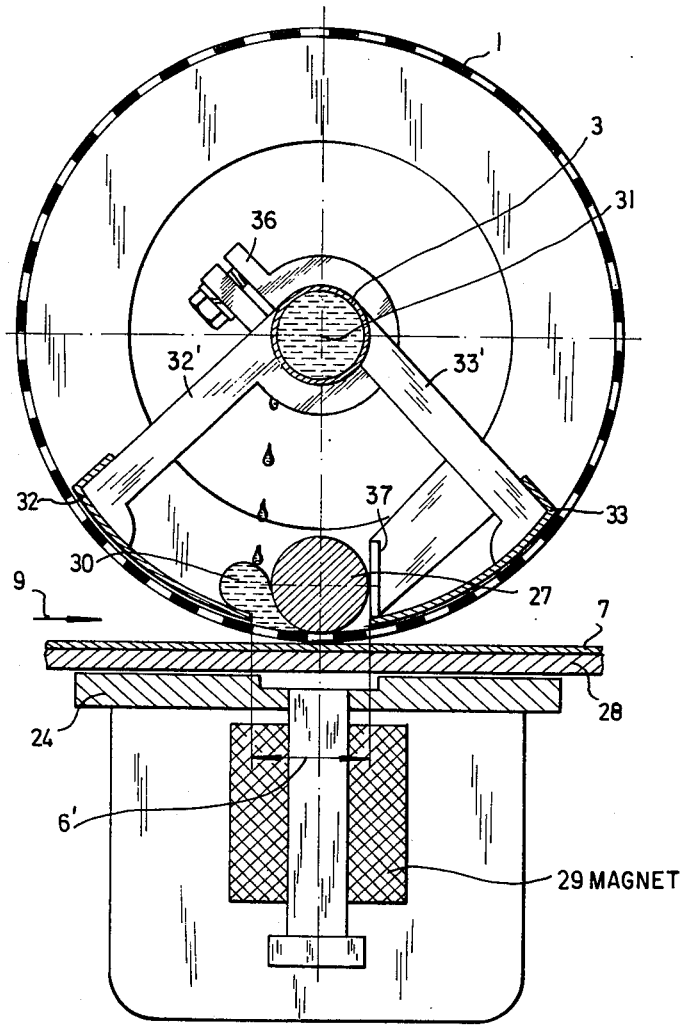
FIGS. 3 and 4 show another embodiment of the invention in an open and a closed shutter position, respectively.
Figure 4:
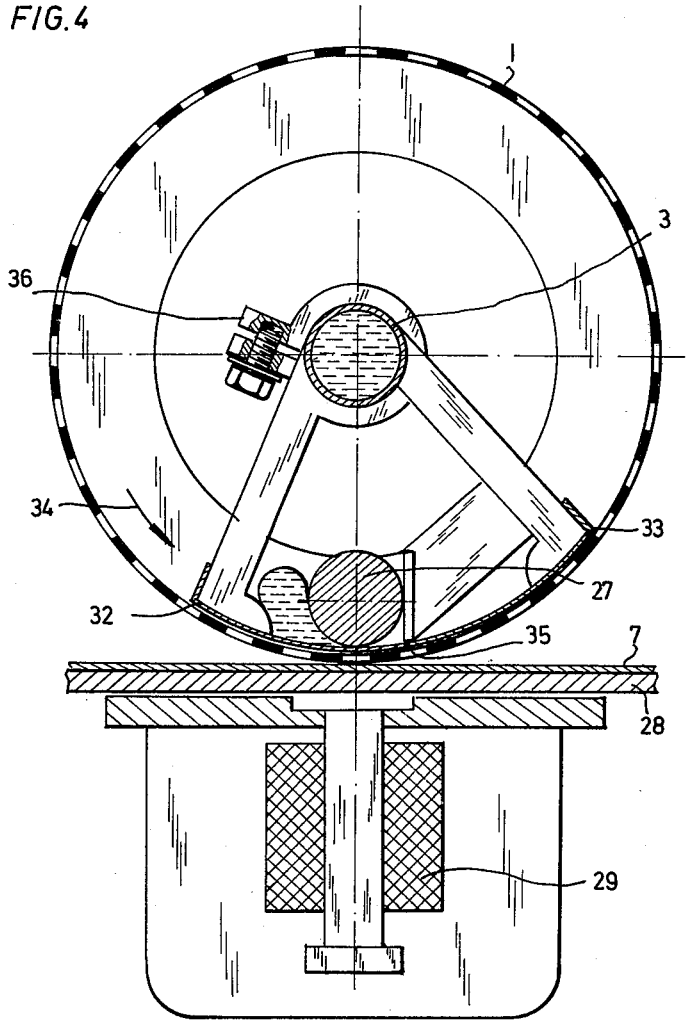

In the modified system of FIGS. 3 and 4, the same designations apply as in FIGS. 1 and 2. The screen 1 envelops a floatingly disposed roller-type applicator or scraper 27 while overlying the substrate 7 to be imprinted, the printing mat 28, and the printing table 24 which contains electromagnets 29 (only one shown). Upstream of the roller scraper 27 is a pool of dye 30 which can be replenished with dyestuff from the tube 3 as needed. The tube 3, centered in this embodiment on the screen axis 31, supports two relatively adjustable shutter parts 32 and 33 in the form of arcuate blades hugging the inner screen surface, these blades being carried on arms 32′, 33′. In FIG. 3 I have shown the working position of the machine in which the shutter parts 32 and 33 are spaced apart so as to form a sufficient gap 6′ for the dyestuff emerging from a narrow penetration zone of the screen 1. In the working position of FIG. 3, the applicator 27 rests directly on the screen 1 and, with the screen rotating counterclockwise (arrow 8, FIG. 1), is being pressed against a stationary guide surface 37. In the event of the machine being stopped, the shutter part 32, as shown in FIG. 4, is moved in the direction 34 until it edge 35 abuts the shutter part 33 after traversing the pool 30 on the upstream side of applicator 27. This closure movement is facilitated by loosening a clamp 36 normally fastening the arm 32' to the supply tube 3, so that the movable blade 32 is automatically entrained in the direction 34 by the rotating screen 1 until it abuts the fixed blade 33 after its leading edge has lifted the roller 27 off the screen. In principle, in the event of a stoppage, both shutter parts 32 and 33 could be moved in synchronism so that, though the gap 6' between these two blades does not actually disappear, the emergence of dyestuff is nevertheless prevented since the floating applicator roller 27 is held in a slightly elevated position above the lowest point of the screen by magnetic force, coming to rest on the confronting edges of the shutter blades 32 and 33, whereby the flow of dyestuff is effectively blocked. From FIG. 3 is will be noted that the leading edge of blade 32 and the guide surface 37 form the upstream and the downstream boundary, respectively, of the penetration zone defined by the gap 6'.

While I have disclosed two specific embodiments of the present invention, it is to be understood that the same are given by way of example only and not in a limiting sense.

I claim:

1. In a printing machine having an apertured screen movable in a predetermined direction and a source of dyestuff overlying a narrow penetration zone in the path of movement of said screen for imprinting an underlying substrate through the interstices of the screen, in combination:

an applicator roller normally resting floatingly on said screen, said roller being rotatable by the moving screen for forcing dyestuff from said source through said interstices in said penetration zone;

stationary guide means above said screen defining a downstream boundary of said penetration zone for preventing entrainment of said roller by the moving screen; and a shutter blade above said screen provided with a leading edge defining an upstream boundary for said penetration zone, said blade being movable along the upper screen surface across said penetration zone toward said guide means for lifting said roller off said screen while temporarily blocking the outflow of said dyestuff.

2. The combination defined in claim 1 wherein said source forms a pool of dyestuff on said screen between said edge and said roller.

3. The combination defined in claim 1, further comprising magnetic means underneath said penetration zone urging said roller onto said screen.

4. The combination defined in claim 1 wherein said source comprises a supply tube horizontally disposed above said roller, said blade being swingably supported on said supply tube.

5. The combination defined in claim 4 wherein said screen is a rotatable cylinder centered on said supply tube and enveloping said applicator, said source and said blade, said penetration zone extending along the bottom of said cylinder.

6. The combination defined in claim 5 wherein said blade has a curvature conforming to that of said screen.

* * * * *